United States Patent [19]

Tost

[11] 4,040,385

[45] Aug. 9, 1977

[54] APPARATUS FOR DEPOSITING FLUX-FLUID ONTO CONDUCTOR PLATES

[75] Inventor: Heinrich Tost, Nurnberg, Germany

[73] Assignee: Grundig E.M.V. Elektro-Mechanische Versuchsanstalt Max Grundig, Fuerth, Germany

[21] Appl. No.: 748,641

[22] Filed: Dec. 8, 1976

[30] Foreign Application Priority Data

May 3, 1976 Germany ..... 7613874

[51] Int. Cl.[2] ..... B05B 1/28; B05B 3/08

[52] U.S. Cl. ..... 118/326; 118/DIG. 16

[58] Field of Search ..... 118/DIG. 16, 300, 326; 239/220, 219, 127; 68/200; 427/421, 424–427

[56] References Cited

U.S. PATENT DOCUMENTS

| | | | |
|---|---|---|---|
| 506,389 | 10/1893 | Claus | 239/220 X |
| 629,513 | 7/1879 | Liebscher | 239/220 |
| 1,667,291 | 4/1928 | Larett | 239/220 |
| 1,683,259 | 9/1928 | Perdue | 239/220 |
| 2,199,093 | 4/1940 | Wolfenden | 239/220 X |
| 2,865,325 | 12/1958 | Leston et al. | 118/DIG. 16 |
| 2,986,337 | 5/1961 | Claire | 118/DIG. 16 |
| 3,940,782 | 2/1976 | Neeb et al. | 118/259 X |

FOREIGN PATENT DOCUMENTS

| | | | |
|---|---|---|---|
| 514,478 | 11/1920 | France | 239/220 |

*Primary Examiner*—Morris Kaplan

[57] ABSTRACT

An apparatus for depositing flux-fluid onto conductor plates consisting of a reservoir, an overflow bath receiving flux-fluid from the reservoir, a rotating brush the bristles of which are dipped into the flux-fluid in the overflow bath as the brush is rotated and thereafter caused to impinge upon a stripping bar whereby the flux-fluid is stripped from the bristles and directed through a gap onto the conductor plates as a spray.

7 Claims, 1 Drawing Figure

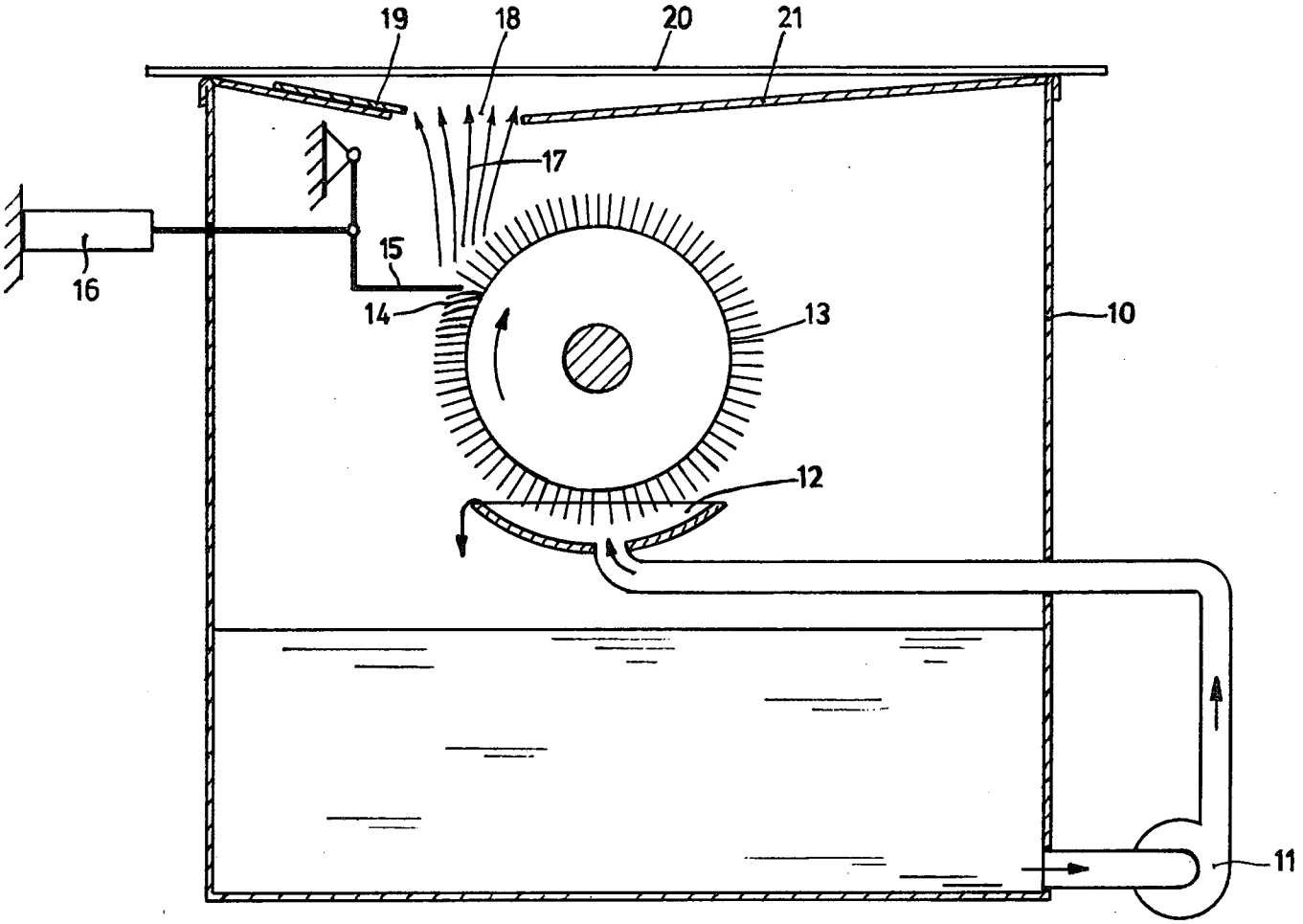
10
11
12
13
14
15
16
17
18
19
20
21

APPARATUS FOR DEPOSITING FLUX-FLUID ONTO CONDUCTOR PLATES

BACKGROUND OF THE INVENTION

It is known in the art to spray flux-fluid onto conductor plates by means of spray nozzles with the help of compressed air. The disadvantages of this include relative high price of equipment and required high maintenance effort.

Further it is old to foam the flux-fluid and bring it in contact with the conductor plate in this condition. The great disadvantage of this technique is the danger of incrustation or pasting together of the parts of the equipment.

Further it is also known to use a rotating sieve drum, which is partially immersed in flux-fluid and adhered flux-fluid is blown against the conductor plate by air nozzles located inside of the sieve drum. This known arrangement requires a high maintenance effort also, because of the continuing danger of paste up or the sieve and of the air nozzles.

SUMMARY OF THE INVENTION

The subject invention provides an apparatus of the type referred to above which insures sparse consumption of flux-fluid and a reliable wetting of the conductor plates with low maintenance requirements.

In this invention a cylindrical brush, which is partly dipped in and rotated through a bath of flux-fluid, is rotated past a stripping bar so that its bristles, after they emerge from the bath by rotation of the cylindrical brush, contact the stripping bar which is adjustable so that it contacts the bristles more or less. A guidance track is mounted above the cylindrical brush to guide the conductor plates. The flux-fluid is stripped from the bristles by the stripping bar and directed through a gap onto the conductor plates as a spray.

The bristles of the cylindrical brush can be made of natural fibers, of artificial fibers or can be metal fibers.

BRIEF DESCRIPTION OF THE DRAWING

The FIGURE of drawing is a partially sectional view of an apparatus for depositing flux-fluid onto conductor plates, constructed in accordance with the teaching of this invention.

DESCRIPTION OF THE PREFERRED EMBODIMENT

Housing 10 serves as housing and storage container for flux-fluid. Pump 11 transports the flux-fluid from the storage container through a conduit into an overflow bath 12, where the overflow insures that the fluid level remains at the same and desired height. When the pump is not operating the flux-fluid returns to the tank 10 and the bath 12 and conduit are clean. Upon rotation of cylindrical brush 13 its bristles 14 reach into the overflow bath 12, in which they are wetted.

A stripping bar 15 which is movable into the path of the bristles 14 is provided. The movement of bar 15 into and out of the path of the bristles is accomplished preferably by means of a magnetic or compressed air drive 16.

As each flexible bristle 14 moves into contact with bar 15 after wetting in the overflow bath 12 it is held back in its motion, momentarily, by the stripping bar 15 and then snaps forward with high speed after passing the stripping bar 15 and upon release. The fluid, which is still on the bristle 14 at this moment, is thrown against the conductor plate 20, which is to be wetted. This occurs in the form of a spray 17 with very fine distributed fluid particles. The spray 17 is thrown through a gap 18 formed in upper cover plate 21 of the housing 10, the width of which can be changed by a slide 19. An excellent wetting of the conductor plate 20 is thus achieved.

It has been found advantageous to have a slight incline to the upper cover plate 21 of the housing 10 in direction of the gap 18, to provide a back flow of surplus fluid to the storage container.

It has been found to be especially advantageous to construct cylindrical brush 13 from nylon with densely arranged, short bristles of sufficient hardness and to operate at a rotational speed of 8 to 25 RPM of the cylindrical brush.

The stripping bar 15 is mounted preferably about 35° above the center of the cylindrical brush 13. At this position a spray height of about 120 mm is achieved.

The thickness of the flux-fluid layer at the conduction plate can be changed by altering the RPM of the cylindrical brush 13, by altering the width of the gap 18 or by altering the hardness and surface condition of the bristles 14 as well as by altering the position of the stripping bar 15 in relation to the cylindrical brush 13.

The width of the cylindrical brush 13 is preferably somewhat larger than the needed working width.

For an apparatus constructed in accordance with this invention the only required maintenance is the control of the quantity and density of the stored flux-fluid. A paste up of the brush cannot occur, even after a long period of operation or standstill, since the overflow bath 12 becomes empty as soon as the pump 11 is stopped.

I claim:

1. An apparatus for depositing flux-fluid onto a conductor plate including in combination: a housing containing a source of said flux-fluid; an open receptacle bath disposed within said housing and above said source; a horizontally disposed rotary brush having flexible bristles in functional association with said receptacle; conduit means including a pump device communicating said source and receptacle whereby said receptacle is charged and excess flux-fluid overflows the receptacle and is returned to the source; an adjustable stripping bar disposed in the path of said brush bristles; said housing including a cover member having an adjustable dispensing slot in operative association with said brush and stripper bar; and said cover being inclined downwardly towards said slot; a guidance path for said conductor plate above said housing and in operative association with said slot; whereby upon rotation of said brush, the bristles are flexed and sprung by said stripper bar to effect a spray of said flux-fluid through said slot and onto said conductor plate and whereby flux-fluid spray intercepted by said cover is generally directed towards said slot.

2. An apparatus in accordance with claim 1 in which the stripping bar is movable by adjusted of a magnetic drive.

3. An apparatus in accordance with claim 1 in which the stripping bar is adjusted by means of a pneumatic drive.

4. An apparatus in accordance with claim 1, in which the bristles are of natural fiber.

5. An apparatus in accordance with claim 1, in which the bristles are of artificial fiber.

6. An apparatus in accordance with claim 11, in which the bristles are of metal.

7. An apparatus in accordance with claim 1, in which the pump is a centrifugal pump.

* * * * *